US011774908B2

(12) United States Patent
Bonenfant et al.

(10) Patent No.: US 11,774,908 B2
(45) Date of Patent: Oct. 3, 2023

(54) DEVICE FOR CONTROLLING A HOROLOGICAL MOVEMENT WITH TACTILE FEEDBACK AND TIMEPIECE, IN PARTICULAR A WATCH, COMPRISING SUCH A DEVICE

(71) Applicant: MECO SA, Grenchen (CH)

(72) Inventors: Julien Bonenfant, Bienne (CH); Rémy Thiry, Les Bréseux (FR); Samuel Geiser, Bienne (CH)

(73) Assignee: MECO SA, Grenchen (CH)

( * ) Notice: Subject to any disclaimer, the term of this patent is extended or adjusted under 35 U.S.C. 154(b) by 59 days.

(21) Appl. No.: 17/645,173

(22) Filed: Dec. 20, 2021

(65) Prior Publication Data

US 2022/0291630 A1 Sep. 15, 2022

(30) Foreign Application Priority Data

Mar. 10, 2021 (EP) ..... 21161683

(51) Int. Cl.
*G04B 3/04* (2006.01)

(52) U.S. Cl.
CPC ..... *G04B 3/046* (2013.01); *G04B 3/041* (2013.01)

(58) Field of Classification Search
CPC ..... G04B 3/046; G04B 3/041; G04B 3/048; G04B 27/00; G04B 27/008; G04B 27/06; G04B 37/106
See application file for complete search history.

(56) References Cited

U.S. PATENT DOCUMENTS 8,721,171 B2 * 5/2014 Tsuji ..... G04B 37/081 368/319
8,905,631 B2 * 12/2014 Sakurazawa ..... G04B 3/043 368/308

FOREIGN PATENT DOCUMENTS

| | | |
|---|---|---|
| EP | 1 091 269 A1 | 4/2001 |
| EP | 2 607 972 B1 | 4/2016 |
| EP | 3 245 563 B1 | 12/2020 |
| JP | 2014-89109 A | 5/2014 |
| JP | 2016-65734 A | 4/2016 |

OTHER PUBLICATIONS

European Search Report for EP 21 16 1683 dated Aug. 19, 2021.

* cited by examiner

*Primary Examiner* — Edwin A. Leon
(74) *Attorney, Agent, or Firm* — Sughrue Mion, PLLC

(57) ABSTRACT

A control device (10) for a horological movement, including a first part including a sliding guide tube (11) intended to be fixed relative to the horological movement, and a second movable part (12) slidably guided by the guide tube in an axial direction, relative to the first part, between an active position wherein it is able to be integral, by means of an adjustment rod (120), with a component of the horological movement, and an inactive position wherein the adjustment rod is intended to release the component of the horological movement. The second part includes a head (140) covering a reversible elastic casing module (130) fixed to the adjustment rod and arranged so as to occupy a rest state when the second part occupies the active and inactive positions and being urged by the guide tube when the second part moves between these positions.

14 Claims, 2 Drawing Sheets

DEVICE FOR CONTROLLING A HOROLOGICAL MOVEMENT WITH TACTILE FEEDBACK AND TIMEPIECE, IN PARTICULAR A WATCH, COMPRISING SUCH A DEVICE

CROSS REFERENCE TO RELATED APPLICATION

This application claims priority to European Patent Application No. 21161683.4 filed Mar. 10, 2021, the entire contents of which are incorporated herein by reference.

TECHNICAL FIELD OF THE INVENTION

The invention relates to the field of watchmaking, and in particular devices for controlling horological movements of timepieces, such as watches.

The invention relates in particular to a device for controlling a horological movement with tactile feedback and a timepiece, in particular a watch, comprising such a control device.

TECHNOLOGICAL BACKGROUND

In the field of watchmaking, control devices, such as push buttons or push crowns, allow the control and/or adjustment of mechanical or electronic horological movements disposed inside a case of a timepiece, for example a watch.

More particularly, the control devices can be intended, for example, for winding, time setting or adjusting any function of a horological movement.

The control devices of the prior art are at least movable in translation relative to the housing between an active, adjustment and/or control position, and an inactive, rest position. To this end, the control devices generally comprise a head extending radially outside the housing so that it can be handled by a user.

Typically, the head is connected to the adjustment rod, which is adapted to act, directly or indirectly, on the horological movement during displacement of said head.

There is a need for the user to feel when changing the position of the controller by handling the head. This need is all the more noticeable when the timepiece includes an electronic horological movement.

Indeed, generally, the devices for controlling mechanical horological movements actuate mobiles of said device when they move between their active and inactive positions, so that the user feels a tactile feedback in the form of a slight resistance.

However, this resistance may not be sufficient to cause remarkable tactile feedback for the user, that is to say they may not feel it.

SUMMARY OF THE INVENTION

The invention meets this need by providing a solution for a device for controlling a horological movement providing a tactile feedback to a user when the latter changes the position of said control device, said tactile feedback being of sufficient intensity to be felt by a user.)

More specifically, the invention relates to a device for controlling a horological movement including, on the one hand, a first part comprising a sliding guide tube intended to be fixed relative to said horological movement, and on the other hand, a second movable part slidably guided by the guide tube in a direction called "axial direction", relative to said first part, between an active position wherein it is able to be integral, by means of an adjustment rod, with a component of the horological movement, and an inactive position wherein said adjustment rod is intended to release the component of the horological movement.

The second part comprises a head covering a reversible elastic casing module fixed to the adjustment rod and arranged so as to occupy a rest state when the second part occupies the active and inactive positions and being urged by the guide tube when the second part moves between these positions.

Thus, during its handling, in particular its translation, by a user, the second part goes against elastic casing forces during its change of position, which causes a sensation of tactile feedback to the user and more precisely, a feeling of indexing, indicating to the user the change in position of the second part.

Moreover, the elastic casing forces being generated by the elastic casing module housed within the control device, and more particularly covered by the head, the tactile feedback is of sufficient intensity to be felt by a user.

In particular embodiments, the invention may further include one or more of the following features, taken in isolation or in any technically possible combination.

In particular embodiments, when it urges the elastic casing module, the guide tube exerts, by a radial projection, a force counteracting an elastic return force in a radial direction, this force being the source of the elastic casing force.

In particular embodiments of the invention, the radial projection is formed by a lip, for example annular lip, arranged at one end of the guide tube.

In particular embodiments of the invention, the guide tube has the shape of a stepped cylinder, comprising a first cylindrical portion an outer peripheral surface of which is guided in translation by a peripheral wall of a blind cavity of the head, and comprising a second cylindrical portion, an inner peripheral surface of which is guided in translation around the adjustment rod.

In particular embodiments of the invention, the guide tube includes a shoulder between its two cylindrical portions, the first portion receiving an elastic member arranged to bear against said shoulder and the elastic casing module, said member working in compression so as to generate a force tending to move the elastic casing module away from the guide tube.

In particular embodiments of the invention, the first portion of the guide tube includes a recess receiving the elastic casing module when the second part occupies the active position, said elastic casing module being set back from said recess when the second part occupies the active position.

In particular embodiments of the invention, the elastic casing module is interposed between the adjustment rod and the head, so that the head is fixed to the adjustment rod by means of the elastic casing module.

In particular embodiments of the invention, the elastic casing module comprises a cage extending between two end walls connected to each other by a peripheral wall, the end walls being respectively fixed to the head and to the adjustment rod. Said cage receives an elastic element projecting through the peripheral wall, that is to say through said cage.

In particular embodiments of the invention, the elastic element includes at least one slide engaged into a through orifice of the peripheral wall so as to extend beyond said cage, said at least one slide being adapted to translate in a direction perpendicular to the sliding direction of the adjustment rod and being subjected to an elastic return force tending to maintain the slide in the through orifice by an elastic member.

In particular embodiments of the invention, the elastic element includes a sole fixed to the peripheral wall, the elastic member being interposed between the sole and said slide and working in compression.

In particular embodiments of the invention, the elastic element includes two slides respectively engaged into a through orifice of the peripheral wall so as to extend beyond said cage, said slides being adapted to translate in a direction perpendicular to the sliding direction of the adjustment rod and being subjected to an elastic return force tending to keep the slide into the through orifice by an elastic member.

In particular embodiments of the invention, the elastic member is interposed between the slides and works in compression.

In particular embodiments of the invention, the slide includes at its distal end a hemispherical shape against which the guide tube is intended to bear during the displacement of the second part relative to the first part between the active and inactive positions.

In particular embodiments of the invention, the at least one slide is formed by a ball.

According to another aspect, the present invention also relates to a timepiece comprising a control device as described above, a case wherein a horological movement is housed, and through which said control device is inserted, the adjustment rod being connected to said horological movement.

BRIEF DESCRIPTION OF THE FIGURES

Other features and advantages of the invention will become apparent upon reading the following detailed description given by way of non-limiting example, with reference to the appended drawings wherein.

DETAILED DESCRIPTION OF THE INVENTION

Figure 2:
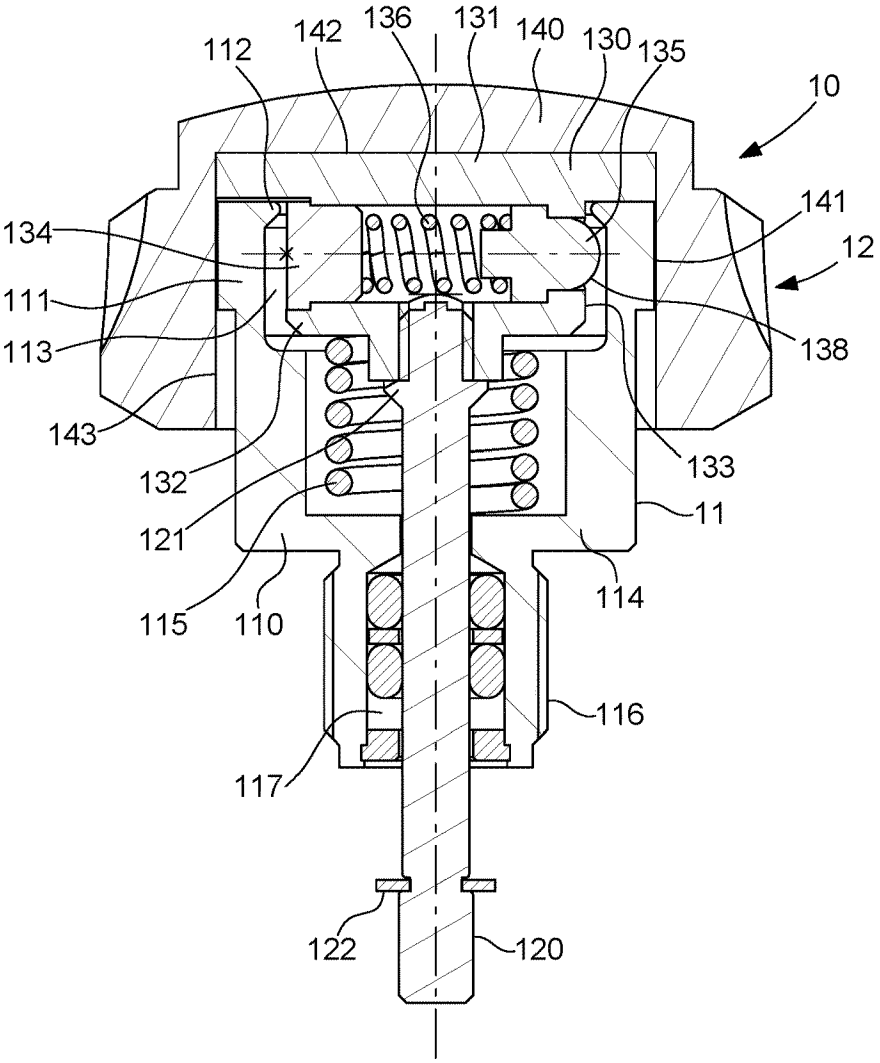
FIG. 2 shows a longitudinal sectional view of the control device of FIG. 1 wherein the two parts are positioned in the active position.
Figure 1:
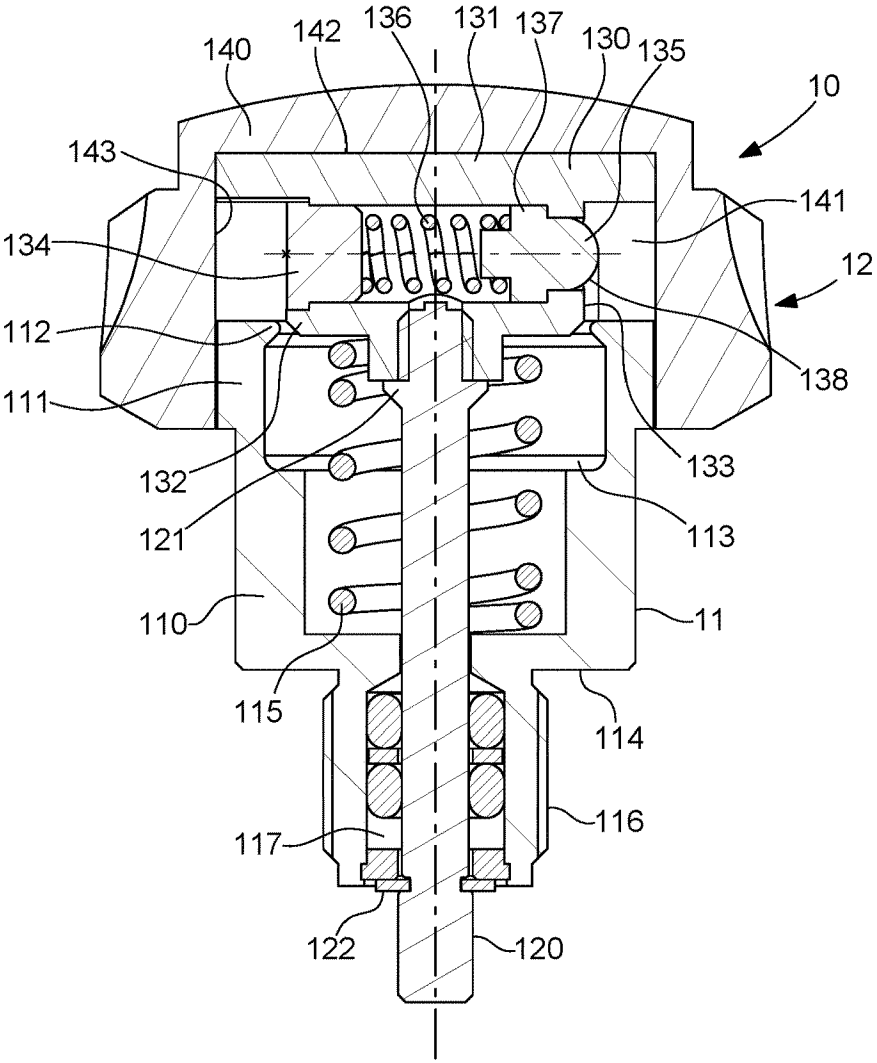
FIG. 1 shows a longitudinal sectional view of a device for controlling a horological movement according to a preferred exemplary embodiment of the invention, said control device including two parts in the inactive position.

FIGS. 1 and 2 show a preferred example of a control device 10 of a horological movement according to the present invention.

The control device 10 can be in the shape of a push crown, winding crown or any crown or button allowing to act on the horological movement by pressure of the user.

The control device 10 is intended to be engaged through a middle part of a case of a timepiece, in particular of a watch, in a manner known to the person skilled in the art, wherein the horological movement is housed.

More particularly, for this purpose, the control device 10 according to the invention includes a first part comprising a sliding guide tube 11 intended to be fixedly engaged into a through orifice extending radially in the middle part. In other words, the guide tube 11 is intended to be fixed relative to the horological movement.

Moreover, the control device 10 includes a second part 12 comprising an adjustment rod 120 extending through the guide tube 11, said rod being fixed, by one of its ends, to a reversible elastic casing module 130. The second part 12 also comprises a head 140 covering the elastic casing module 130, as described in more detail below.

The adjustment rod 120 is slidably engaged in an axial direction through the guide tube 11, so that the second part 12 slides relative to the first part between an active position, shown in FIG. 2, wherein the adjustment rod 120 is able to be integral with a component of the horological movement, and an inactive position, shown in FIG. 1, wherein the adjustment rod 120 is able to release the component of the horological movement, that is to say that it is not integral with said component.

This change in position of the second part is caused by pressure of the head 140 by a user of the watch.

In other words, when the second part 12 occupies the active position, it is retracted relative to the first part and when the second part 12 occupies the inactive position, it is deployed relative to the first part.

In the present text, the term "integral" is understood to mean that two parts are kinematically connected together so that one can transmit a movement or a force to the other. In other words, when the adjustment rod 120 is integral with the horological movement, it can act on the latter.

Advantageously, the control device 10 according to the invention is configured so that the elastic casing module 130 occupies a rest state when the second part 12 occupies the inactive and active positions, and is urged, that is to say constrained by the guide tube 11 when the second part 12 moves between these positions.

Thanks to this feature, when the user handles, more precisely presses, the control device 10 so as to translate the second part 12 to its active position, it goes in particular punctually against elastic casing forces. The user therefore feels a brief mechanical resistance, until the second part 12 reaches its active position, wherein an elastic element, described in detail below, no longer exerts elastic casing forces, the user then feeling a release of these forces.

Thus, the control device 10 causes in the user a feeling of tactile feedback, and more precisely, a clear sensation of indexing when they handle the second part 12 as described above.

A particular embodiment of the invention shown in FIGS. 1 and 2 is described in more detail below.

As shown in FIGS. 1 and 2, the head 140 has a blind cavity 141 of substantially cylindrical shape, defined by a back wall 142 and by a peripheral wall 143.

Advantageously, the cavity 141 receives the elastic casing module 130, the latter being fixed against the back wall 142, either by driving or by gluing.

The elastic casing module 130 comprises a substantially cylindrical cage extending between two end walls 131 and 132 connected to each other by a peripheral wall 133.

In particular, the cage is fixed to the head 140 by a first end wall 131, preferably having a cross section of shape complementary to that of the cavity 141, in particular to that of the back wall 142 of said cavity 141.

The cage is fixed, by a second end wall 132, to the adjustment rod 120. In other words, the elastic casing module 130 is interposed between the adjustment rod 120 and the head 140, so that said head 140 is fixed to the adjustment rod 120 by means of said module.

Moreover, as visible in FIGS. 1 and 2, the cage receives an elastic element extending radially through said cage and projecting, by at least one of its ends, through the peripheral wall 133.

More specifically, in one embodiment, the elastic element includes a sole 134 fixed to the peripheral wall 133 and a slide 135 movably engaged in translation into a through orifice of the peripheral wall 133, so as to extend beyond said peripheral wall 133.

The slide 135 and the sole 134 are diametrically opposite within the cage and said slide 135 is adapted to translate in a direction perpendicular to the sliding direction of the adjustment rod 120.

The slide 135 and the sole 134 are connected to each other by an elastic member 136, which working in compression subjects said slide 135 to an elastic return force tending to move it away from the sole 134, said elastic return force being at the origin of the elastic casing force.

The slide 135 has a proximal end by which it is fixed to the elastic member 136 which is formed, in the preferred embodiment shown in FIGS. 1 and 2, by a coil spring, and a distal end by which it protrudes beyond the cage.

Between the distal end and the proximal end, the slide 135 includes a radial flange 137 arranged to abut against the peripheral wall 133 of the cage, when the elastic casing module 130 occupies the rest state. Another function of the flange 137 is to guide the slide 135 in translation, said flange 137 being fitted between the first and second end walls with a mechanical clearance allowing displacement of the slide 135.

In the preferred exemplary embodiment, the slide 135 is also guided in translation by a cylindrical portion through which it is engaged through the cage, and more particularly, through an orifice of the cage, the cross section of which has a shape complementary to that of the cross section of the cylindrical portion.

The slide 135 includes at its distal end a hemispherical shape 138 against which the guide tube 11 is intended to bear during the displacement of the second part 12 relative to the first part between the active and inactive positions, as described in more detail below.

Figure 3:
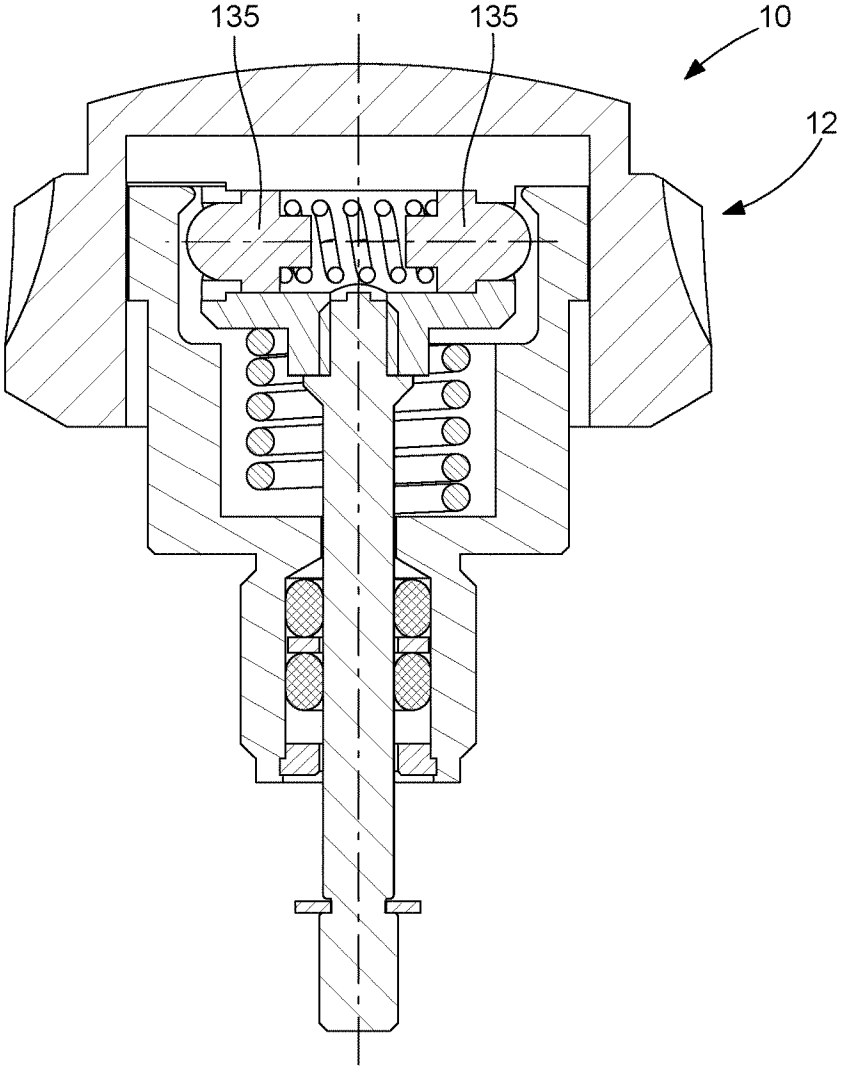
FIG. 3 shows a longitudinal sectional view of the control device of FIG. 2 comprising an elastic element according to another embodiment.

In another embodiment of the elastic element shown in FIG. 3, the latter includes, instead of the sole 134, another slide 135. The two slides 135 are then intended to be urged concomitantly by the guide tube 11 when the second part 12 moves between the active and inactive positions.

Figure 4:
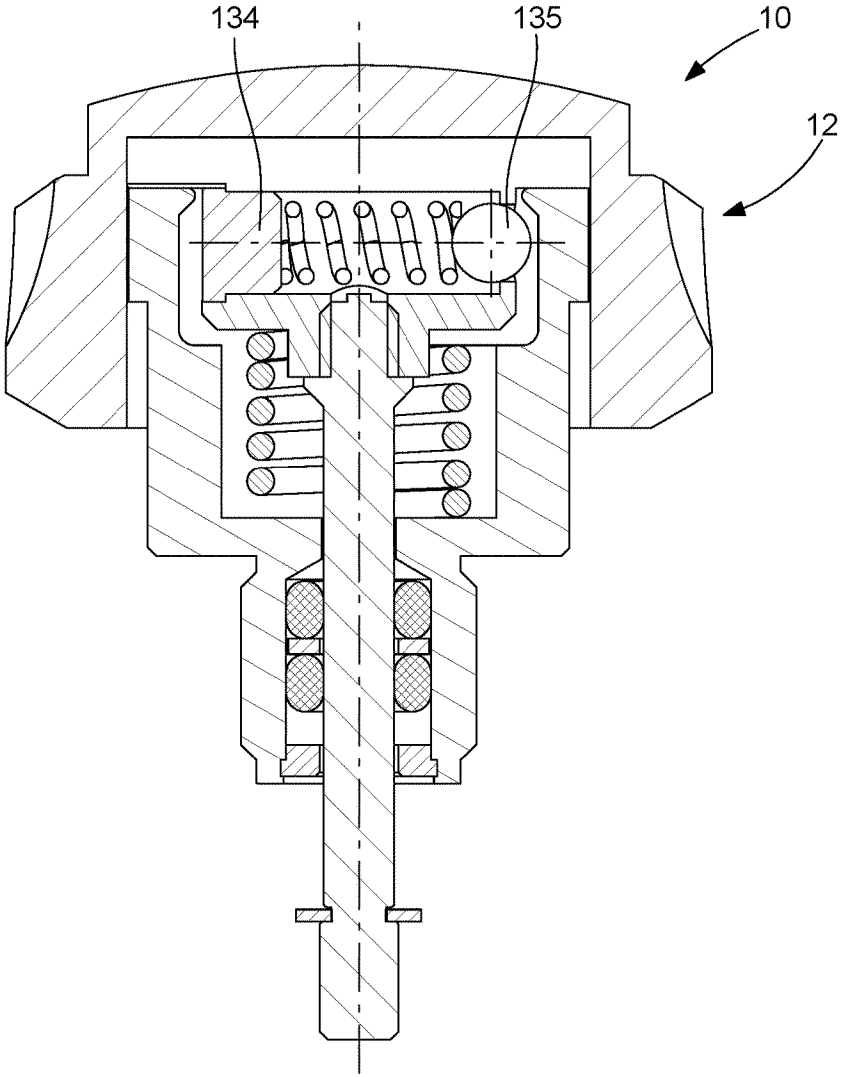
FIG. 4 shows a longitudinal sectional view of the control device of FIG. 2 comprising an elastic element according to yet another embodiment.

In yet another embodiment of the elastic element shown in FIG. 4, the slide 135 is formed by a ball protruding beyond the cage, said ball having a diameter greater than that of the orifice through which they are engaged. Alternatively, the orifice may have means for retaining said ball, such as a reduction in section.

In another embodiment of the invention, the elastic element includes, instead of the sole 134, another slide 135 and the slides are formed by balls.

The second end wall 132 of the cage comprises means for fastening to the adjustment rod 120. Preferably, these fastening means can be formed of a central tapped hole with which a threaded end, called the "proximal end", of the adjustment rod 120 cooperates by screwing, or else a central through bore with which said proximal end of the adjustment rod 120 cooperates by tight fitting.

To this end, the adjustment rod 120 may, furthermore, include at the proximal end, an annular shoulder 121 intended to abut against the second end wall 132. More particularly, the annular shoulder 121 is intended to abut against a boss extending around the tapped hole or the central bore of the cage.

Moreover, the adjustment rod 120 includes a distal stop 122, formed in the preferred exemplary embodiment of the invention by an elastic ring housed in an annular groove extending radially in said adjustment rod 120.

The guide tube 11 bears against the distal stop when the second part 12 occupies the inactive position, as shown in FIG. 1.

The guide tube 11 preferably has two translational guide areas relative to the second part 12.

More particularly, in the preferred exemplary embodiment of the invention, the guide tube 11 has the shape of a stepped cylinder comprising a first cylindrical portion and a second cylindrical portion. As illustrated in the figures, the first cylindrical portion has a diameter greater than the second cylindrical portion.

The first cylindrical portion is engaged in the cavity 141 of the head 140, said first cylindrical portion including a peripheral wall 110 the outer surface of which slidably cooperates by sliding fit with the peripheral wall 143 of the head 140. In particular, the peripheral wall 110 may comprise an annular bearing surface 111 provided to slide against the peripheral wall 143 of the head 140.

The first cylindrical portion comprises a free end, opposite the second cylindrical portion, comprising a radial projection 112 provided to exert a force against the slide 135 counteracting the elastic return force exerted by the elastic member 136, when the guide tube 11 urges the elastic casing module 130.

This force helps to generate the elastic casing forces.

More specifically, the radial projection 112 is formed by a lip extending towards the inside of the first cylindrical portion. Here "the inside" of the first cylindrical portion, is defined as the internal volume delimited by an inner surface of the peripheral wall 110.

As shown in FIGS. 1 and 2, in the preferred exemplary embodiment of the invention, the inner surface of the peripheral wall 110 of the first cylindrical portion comprises an annular recess 113 facing the internal volume. This recess 113 is intended to release a sufficient volume to house the elastic casing module 130 when the second part 12 occupies the active position, as shown in FIG. 2.

The first cylindrical portion comprises a back wall 114 by which it is connected to the second cylindrical portion. Said back wall 114 forms a shoulder against which an elastic member 115 housed inside said first cylindrical portion is advantageously arranged to bear. The elastic member 115 is further arranged to bear against the elastic casing module 130 and works in compression so as to generate a force tending to move the head 140 and the elastic casing module 130 away from the guide tube 11.

Thus, when the user releases the pressure exerted on the head, the second part 12 is driven towards the inactive position by the elastic member 115. The user accompanying the second part 12 in its displacement to the inactive position, feels the elastic casing forces when the radial projection 112 contacts against the slide 135 and punctually forces the elastic member 136, and consequently, they feel the sensation of tactile feedback.

The second cylindrical portion is sleeved around the adjustment rod 120, said second cylindrical portion including a peripheral wall 116 the inner surface of which slidably cooperates by sliding fit with said adjustment rod 120.

Furthermore, the second cylindrical portion includes a recessing 117 receiving seals interposed between the peripheral wall of the second cylindrical portion and the adjustment rod 120.

Finally, the second cylindrical portion comprises a free end opposite the first cylindrical portion, which is provided to bear against the distal stop of the adjustment rod 120 when the second part 12 occupies the inactive position.

The invention claimed is:

1. A control device (10) for a horological movement, comprising:

a first part comprising a sliding guide tube (11) configured to be fixed relative to said horological movement, and a second movable part (12) slidably guided by the guide tube (11) in an axial direction relative to said first part, between an active position wherein it is able to be integral, by means of an adjustment rod (120), with a component of the horological movement, and an inactive position wherein said adjustment rod (120) is intended to release the component of the horological movement, said second part (12) comprising a head (140) covering a reversible elastic casing module (130) fixed to the adjustment rod (120) and arranged so as to occupy a rest state when the second part (12) occupies the active and inactive positions and being urged by the guide tube (11) when the second part (12) moves between these positions, wherein the elastic casing module (130) comprises a cage extending between two end walls connected to each other by a peripheral wall, the end walls being respectively fixed to the head (140) and to the adjustment rod (120), said cage receiving an elastic element projecting through the peripheral wall.

2. The control device (10) according to claim 1, wherein when it urges the elastic casing module (130), the guide tube (11) exerts, by a radial projection, a force counteracting an elastic return force in a radial direction.

3. The control device (10) according to claim 2, wherein the radial projection is formed by a lip arranged at one end of the guide tube (11).

4. The control device (10) according to claim 1, wherein the guide tube (11) has the shape of a stepped cylinder, comprising a first cylindrical portion an outer peripheral wall of which is guided in translation by a peripheral wall (143) of a blind cavity (141) of the head (140), and comprising a second cylindrical portion, an inner peripheral wall of which is guided in translation around the adjustment rod (120).

5. The control device (10) according to claim 4, wherein the guide tube (11) includes a shoulder between its two cylindrical portions, the first portion receiving an elastic member (115) arranged to bear against said shoulder and the elastic casing module (130), said elastic member working in compression so as to generate a force tending to move the elastic casing module (130) away from the guide tube (11).

6. The control device (10) according to claim 4, wherein the first portion of the guide tube (11) includes a recess receiving the elastic casing module (130) when the second part (12) occupies the active position, said elastic casing module (130) being set back from said recess when the second part (12) occupies the active position.

7. The control device (10) according to claim 1, wherein the elastic casing module (130) is interposed between the adjustment rod (120) and the head (140), so that the head (140) is fixed to the adjustment rod (120) by means of said module.

8. The control device (10) according to claim 1, wherein the elastic element includes at least one slide (135) engaged into a through orifice of the peripheral wall so as to extend beyond said cage, said at least one slide (135) being adapted to translate in a direction perpendicular to the sliding direction of the adjustment rod (120) and being subjected to an elastic return force tending to keep the slide (135) into the through orifice by an elastic member (136).

9. The control device (10) according to claim 8, wherein the elastic element includes a sole (134) fixed to the peripheral wall, the elastic member (136) being interposed between the sole (134) and said slide (135) and working in compression.

10. The control device (10) according to claim 8, wherein the elastic element includes two slides (135) respectively engaged into a through orifice of the peripheral wall so as to extend beyond said cage, said slides (135) being adapted to translate in a direction perpendicular to the sliding direction of the adjustment rod (120) and being subjected to an elastic return force tending to maintain the slide (135) in the through orifice by an elastic member (136).

11. The control device (10) according to claim 10, wherein the elastic member (136) is interposed between the slides (135) and works in compression.

12. The control device (10) according to claim 8, wherein the at least one slide (135) includes at its distal end a hemispherical shape (138) against which the guide tube (11) is intended to bear during the displacement of the second part (12) between the active and inactive positions.

13. The control device (10) according to claim 8, wherein the at least one slide (135) is formed by a ball.

14. A timepiece, comprising theft control device (10) according to claim 1, a case wherein the horological movement is housed, and through which said control device (10) is inserted, the adjustment rod (120) being connected to said horological movement.

* * * * *